United States Patent [19]

Dzurik

[11] 4,102,738

[45] Jul. 25, 1978

[54] USE OF CHITOSAN IN CORRUGATING MEDIUM

[75] Inventor: John A. Dzurik, Bethel, Conn.

[73] Assignee: American Cyanamid Company, Stamford, Conn.

[21] Appl. No.: 760,213

[22] Filed: Jan. 17, 1977

[51] Int. Cl.[2] ..... D21H 3/20

[52] U.S. Cl. ..... 162/117; 162/163; 162/175

[58] Field of Search ..... 162/163, 175, 117

[56] References Cited

U.S. PATENT DOCUMENTS

| | | | |
|---|---|---|---|
| 2,047,218 | 7/1936 | Merrill | 427/381 |
| 3,258,393 | 6/1966 | Woodberry et al. | 162/163 |

OTHER PUBLICATIONS

"Developments in Semichemical Pulping with Kraft Green Liquor", Paper Trade Journal, 10/14/74, pp. 25–26.

Dissertation Abstracts, "The Utilization of Chitosan as a Papermaking Additive", Crosby, G. D., 1973.

*Primary Examiner*—S. Leon Bashore
*Assistant Examiner*—William F. Smith
*Attorney, Agent, or Firm*—C. F. Costello, Jr.; John L. Sullivan

[57] ABSTRACT

Chitosan is used to improve the flat crush resistance of corrugating medium. A solution of chitosan in dilute acid is added to corrugating medium pulp containing at least about 0.05%, based on the dry fiber weight, of spent semichemical pulping liquor. The corrugating medium pulp is then formed into corrugating medium sheets, dried and manufactured into corrugating medium.

9 Claims, 2 Drawing Figures

USE OF CHITOSAN IN CORRUGATING MEDIUM

BACKGROUND OF THE INVENTION

This invention relates to the use of chitosan to improve the flat crush resistance in the manufacture of corrugating medium. Specifically, the invention relates to the use of chitosan to improve the flat crush resistance of corrugating medium wherein the corrugating medium is in a fibrous suspension containing residual anionic degraded lignins remaining from the semichemical pulping processes.

In manufacturing corrugating medium the most widely used process is the neutral sulfite semichemical pulping process. This process is also the most popular for semichemical pulping generally.

The cooking liquor used in the neutral sulfite semichemical process is sodium sulfite. Indeed, the term "neutral sulfite" is derived from the fact that the sodium sulfite is used as cooking liquor at a pH of about 7.

The neutral sulfite semichemical (NSSC) process has advantages over other alkaline pulping processes. Some of these are that the neutral sulfite semichemical process produces pulps which make more rigid papers, the process produces high yields for a given degree of delignification, generally high strength, a wide applicability to different wood species, especially those little used in other processes, for example oak, gum, aspen and birch, and the hemicellulose content of the pulp manufactured by the NSSC process is similar to that of the original wood (because the xylose polymers are not hydrolyzed by the relatively neutral liquor.)

There is a trend in the pulping industry to use green liquor as the cooking liquor in place of sodium sulfite in the neutral sulfite semichemical process. The processes which use the green liquor have been termed the green liquor semichemical (GLSC) process and the modified kraft process. See, for example, PAPER TRADE JOURNAL, Oct. 14, 1974, page 25 and PULP AND PAPER, October, 1974, page 56, respectively. These articles are incorporated herein by reference. For the purposes of this invention, these processes, and any other process which uses spent green liquor, can be termed the green liquor process. The green liquor process has all the advantages of the neutral sulfite semichemical process, while being able to utilize spent green liquor directly as the cooking liquor for manufacturing corrugating medium. The green liquor process also produces high yield pulp. Finally, the green liquor process also has the advantage that less total chemical consumption should be needed to produce the same yield of corrugating medium pulp than other semichemical pulping processes.

The degree of separation of the semichemical pulp from the spent semichemical pulping liquor, varies from paper mill to paper mill but is usually not complete. With the trend toward closing-up of papermaking whitewater recirculation systems, these spent liquors can build up to high concentration levels. What has generally been lacking in these semichemical pulping processes is a composition of matter which can be used to increase the flat crush resistance at any effective level of spent green liquor in the manufacture of corrugating medium pulp. The utility of a composition of matter to improve the flat crush resistance will result in the following advantages to the corrugating medium: enable faster production rates of corrugating medium; and less corrugating medium will be necessary to achieve the same strength as corrugating medium without the added composition, i.e. the number of flutes per foot of board and the height of the flutes may be reduced because the strength of the corrugating medium fibers will be improved. Applications requiring double—board or triple—wallboard may be filled by single-lined board or regular corrugated board because of the improved flat crush resistance. Also, the thickness of the corrugating medium, which is usually 0.009 inches in caliper may be reduced to effect the same flat crush resistance of a corrugated board using 0.009 inch corrugating medium.

A known method for improving the flat crush resistance of corrugating medium is to impregnate it with molten sulfur. The method requires a post-treatment, where large amounts of sulfur are driven into the medium by pressure. The post-treatment is also relatively expensive and smelly to use. See, eg., *Pulp and Paper,* J. P. Casey, vol. III, p. 1920, Interscience, N. Y., 1961.

The use of chitosan that I have discovered as useful to improve the flat crush resistance of corrugating medium is superior to sulfur board. Because it is a cationic polymer, chitosan forms an interfiber bond with the corrugating medium fibers. That is, chitosan can be added during the pulping process and not as a surface additive. Therefore, chitosan will not interfere with the adhesion of the corrugating medium to the liner board. Much lower amounts are needed than for sulfur treatment. Finally, special adhesive formulas do not have to be used with the corrugating medium improved by chitosan. Also, a normal amount of adhesive is sufficient to obtain acceptable bonding. All of these properties are improvements over corrugating medium impregnated with molten sulfur to improve the flat crush resistance.

Because chitosan is a cationic polymer, it has an electrostatic attraction to the naturally occurring anionic properties of cellulosic fibers. For this reason, chitosan has been used to improve the dry strength of paper. See, for example, U.S. Pat. Nos. 3,709,780 and 2,047,218 which are incorporated herein by reference.

Other cationic polymers, see e.g. U.S. Pat. No. 3,875,097, also are dry strengthening agents. As a general statement, the degraded anionic, water-soluble lignins present in spent semichemical pulping liquor interact with these other cationic polymers and reduce their dry strengthening properties, making them ineffective in pulps of this type.

SUMMARY OF THE INVENTION

The discovery has now been made that chitosan improves the flat crush resistance over a wide range of spent semichemical pulping liquor when used in a process for manufacturing corrugating medium. The flat crush resistance of the corrugating medium manufactured by this process is also improved. That is, the discovery has been made that chitosan improves the flat crush resistance of corrugating medium independent of the spent semichemical pulping liquor concentration. This is a major break through in the technology as the trend develops to avoid using semichemical pulps containing higher levels of spent liquor. The chitosan solution containing at least about 0.05% based on dry fiber weight of dissolved chitosan is added to a corrugating medium pulp containing at least about 0.05% based on dry fiber weight of spent semichemical pulping liquor.

A chitosan solution containing between about 0.05% and 1.0% based on dry fiber weight of dissolved chitosan is effective in improving the flat crush resistance of spent semichemical pulping liquor. However, a chitosan solution containing between about 0.1% and 0.6% based on dry fiber weight of dissolved chitosan is preferred.

The chitosan solution is effective in improving the flat crush resistance when added to about 0.05% to 100% based on dry fiber weight of spent semichemical pulping liquor. From a practical viewpoint, most paper mills should not operate with an amount of spent semichemical pulping liquor above about 50% based on dry fiber weight. Therefore a range of about 0.05% to 50% based on dry fiber weight of spent semichemical pulping liquor is preferred.

The chitosan solution may be obtained from a commercial source. Alternatively, the chitosan solution may be prepared by dissolving dry flakes of chitosan.

Chitosan, as dry flakes, is dissolved in a dilute acid solution having a pH of about 2.0 to 5.5. The dry flakes of chitosan dissolve in the dilute acid. Alternatively, other solvents such as glycerine-acetic acid or ethylene glycol-acetic acid could be used.

The chitosan solution is added to a fibrous suspension of corrugating medium pulp containing at least about 0.05% based on the dry fiber weight of spent semichemical pulping liquor. The pH of the fibrous suspension is then adjusted to a range between about 5 to 9. A pH range between about 6 to 8.5 is preferred. The steps of forming, drying and corrugating the corrugating medium web are then performed using normal papermaking procedures.

As disclosed in FIG. 2, I have found that the effect of chitosan on the corrugating medium is strongest when the pH of the dilute stock is in the range of about 5 to 9. However, because most corrugating medium pulping processes are performed in the neutral or mildly alkaline range, a pH range of about 7 to about 8 is most preferred.

When the chitosan solution is added to a fibrous suspension of corrugating medium pulp, and the pulp is formed into a web using normal papermaking procedures, I have discovered that the drainage of the web is improved by the addition of the chitosan.

For corrugating medium, the semichemical processes including neutral sulfite and green liquor are preferred because they produce pulp having more rigid paper than the conventional alkaline pulping processes. These semichemical processes are popular generally because of their applicability to different kinds of wood and because they yield a controllable degree of delignification and strength.

The spent semichemical pulping liquor was obtained from the first stage washers of a pulp mill using the green liquor pulping process. Its concentration was 4.5%.

Figure 1:
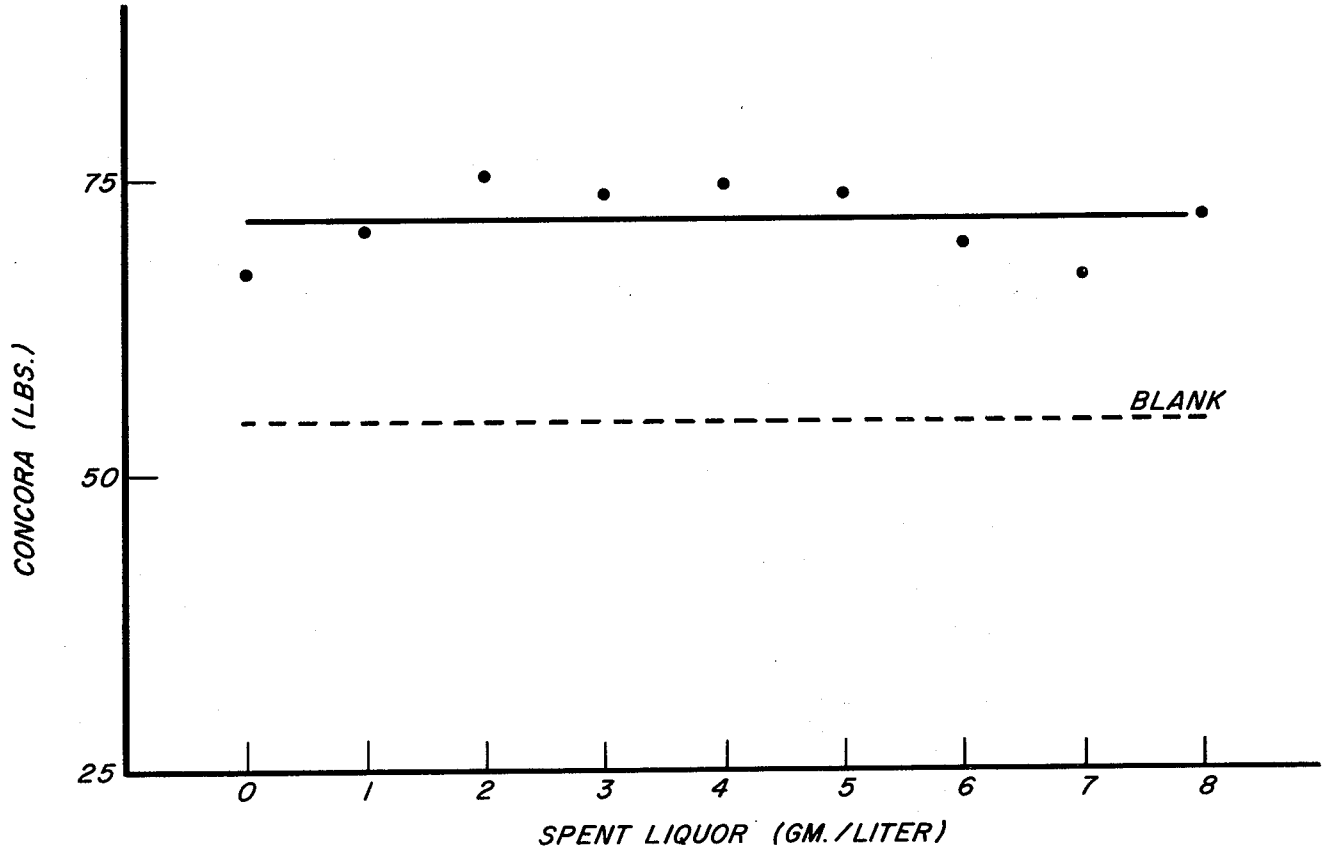
FIG. 1 shows the effect of the level of spent semichemical pulping liquor on the flat crush resistance of corrugating medium. The chitosan used has a medium viscosity of 180 cps. The amount of chitosan added was 0.3% based on the dry weight of the fiber. From FIG. 1 it can be seen that the flat crush resistance of the corrugating medium remains almost constant for spent green liquor in the concentration range of about 0–8 grams/liter.
Figure 2:
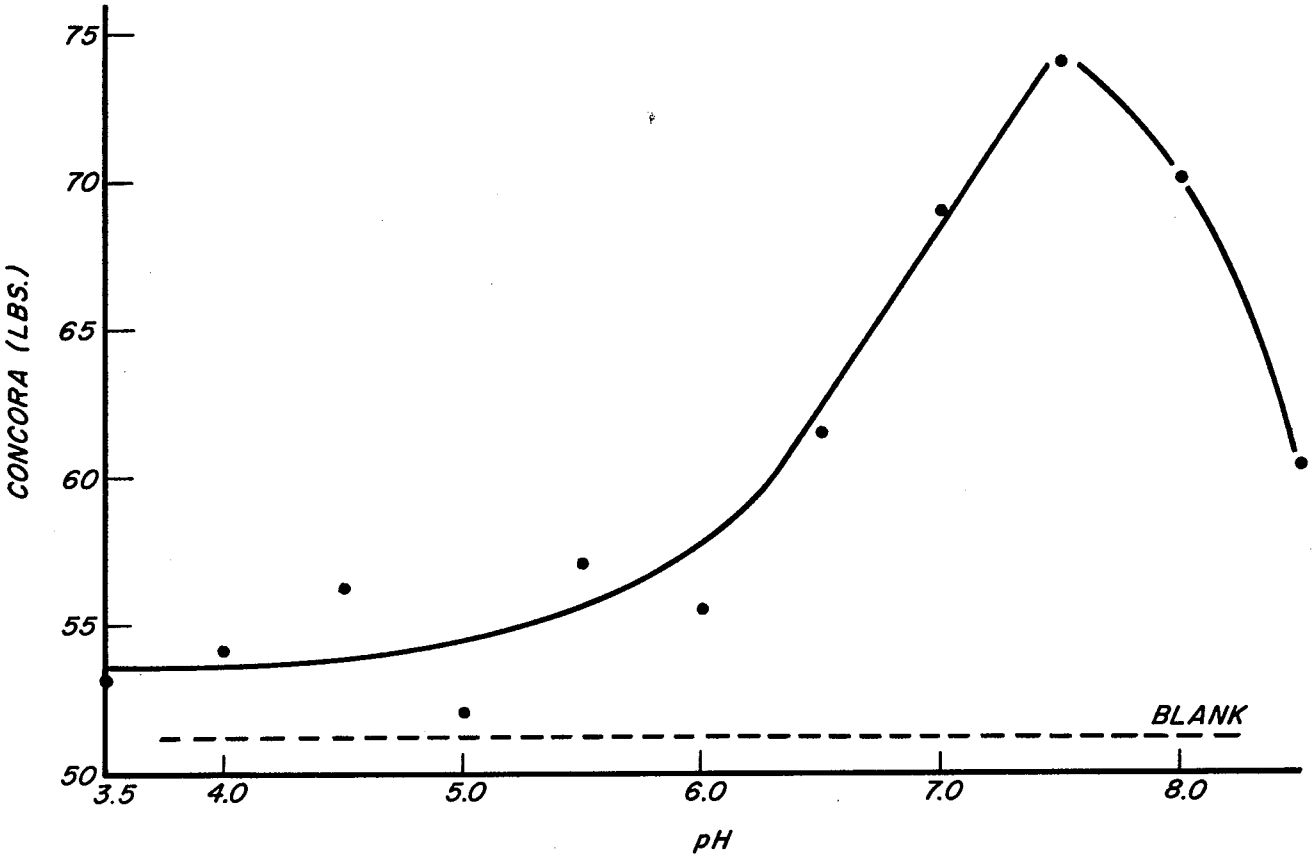

FIG. 2 shows the effect of pH on flat crush resistance. The viscosity and percent of chitosan added were the same as in FIG. 1.

DESCRIPTION OF THE PREFERRED EMBODIMENT

Dry flakes of chitosan may be prepared by the method described in U.S. Pat. No. 2,047,218, incorporated herein by reference. The dry flakes of chitosan can then be dissolved in dilute acid. Alternatively, the dry flakes of chitosan can be dissolved to the extent possible in glycerine or ethylene glycol, both solvents containing a small amount of acetic acid. The dry flakes of chitosan can be pulverized prior to being dissolved. Preferably the acid will have a pH of about 2.0 to 5.5. The dry flakes of chitosan should readily dissolve in the dilute acid solution. However, mild but continuous stirring may be necessary in some instances.

Because of its availability and ease of use, dilute acetic acid and hydrochloric acid are preferred in dissolving the chitosan. It is to be understood, however, that any monobasic aliphatic acid may be used. Examples of such acids include: proprionic, glycollic, lactic, crotonic and pyruvic. Inorganic acids could also be used. In addition, aromatic polybasic acids may be used, such as malonic, sebacic, malic, tartaric, citric and maleic and acids containing aromatic nuclei such as benzoic, benzenesulfonic and sulfanilic. It should be noted that while all of these acids will effectively dissolve dry flakes of chitosan, they may have a deleterious effect upon the corrugating medium pulp. Therefore a trial run is suggested to determine the effect of these acids on the pulp prior to using larger concentrations.

It should be noted that while I have obtained chitosan from naturally occurring chitin, a synthetic resin having the same structure as that of chitosan may also improve the flat crush resistance of corrugating medium in spent green liquor.

The viscosity of the chitosan will also have an effect on the flat crush resistance which chitosan imparts to the corrugating medium. The viscosity of the shrimp used and the percent Concora Crush increase is as follows:

| | % Concora increase |
|---|---|
| Shrimp, low vis., 67 cps at 25° C (5%) | 23.8 |
| Shrimp, med. vis., 180 cps at 25° C (1%) | 30.4 |
| Shrimp, high vis., 270 cps at 25° C (.5%) | 34.9 |

Chitosan is most effectively used to improve the flat crush resistance of corrugating medium if the viscosity is maintained within a range. The effective range of the viscosity is from about 10 to 5000 centipoises for a 1% chitosan solution dissolved in aqueous acetic acid at a pH of 4° and 25° C. The preferred range is in the order of about 100 to 3000 centipoises. It is to be noted that the viscosity of the chitosan is a variable which is dependent on the amount of deacetylation of the naturally occurring chitin. Generally, the higher the viscosity of the chitosan, the greater the tendency for it to be effective.

Besides improving the flat crush resistance, chitosan when added to corrugating medium has the following advantages: the rate of the machine speed can be increased because the amount of refining of the corrugating medium pulp is less to achieve the same amount of flat crush. Also, the quality of the corrugating medium can be changed. That is, a less costly corrugating medium furnish can be used to achieve the same amount of flat crush.

In the semichemical pulping process the cooking liquors used are a combination of sodium sulfite or sodium sulfate and sodium carbonate. By spent semichemical pulping liquor is meant the residual pulping chemicals and degraded wood products in aqueous solution that are left after pulping the wood by the semichemical process. These degraded wood products include water soluble anionic lignins.

The chemistry of spent semichemical pulping liquor is dependent on its reaction with the wood chips in the digestor. Different pulp mills utilize different grades and kinds of wood chips. The amount, temperature and pressure of the cooking liquor used in the digestor may also vary with the pulp mill. Therefore, the inventor does not wish to be bound by any theory in explaining the chemical reaction of the chitosan with the cellulosic fibers in the presence of the spent semichemical pulping liquor.

The examples below are preferred embodiments of the invention. They are not intended and should not be construed as limitations to the claims. All percentages are by weight except where otherwise noted.

EXAMPLE 1

The following example illustrates the independence of the increase in flat crush resistance in the presence of chitosan to spent green liquor of corrugating medium pulp. This example is described graphically in FIG. 1.

Green liquor semichemical pulp consisting of 75% green liquor pulp and 25% unbleached kraft pulp as received, is soaked in deionized water for 1 hour and then beaten (TAPPI standard T 200 05-70) to a Canadian Standard Freeness (TAPPI standard T 227 m-50) of 160 mls at a consistency of 2.5% fiber and a pH of 8.5.

For sheet making an aliquot of the pulp suspension is taken representing 22g based on dry fiber weight. A spent green liquor solution containing 4.5% solids is added slowly over the range from about 0 to 8 grams per liter of pulp suspension which corresponds to a range of 0 to 32% based upon by fiber weight with stirring in a baffled container. Stirring was continued for a few additional minutes, then the chitosan solution (at 0.05% in 0.26M acetic acid pH 3.0–3.5) representing 0.3 percent Chitosan based on the dry weight of the fiber was slowly added with stirring in a baffled container. Finally the pulp suspension was diluted to 0.05% consistency with deionized water containing 200 ppm sodium sulfate and adjusted to a pH of 8.5. This suspension was stirred for a few minutes while the pH was brought up to 8.5 with 12M sodium hydroxide.

Three 1,000 ml aliquots were used to make 5.5g sheets on a Noble and Wood Sheetmaking machine, 1½ press weights on a nip press for dewatering and 1½ minutes at 240° F. on a Noble and Wood chrome platted rotating steam heated drum dryer for drying. A fourth aliquot of 1,000 mls was used for measuring the Canadian Standard Freeness. The sheets made from the three 1,000 ml aliquots were equilibrated at 50% relative humidity and 72° F. for a minimum of 48 hrs., then the Concora crush (TAPPI standard T 809-os-71) data was obtained.

EXAMPLE 2

The following illustrates the drainage improvement of corrugating medium pulp prepared from spent green liquor in the presence of chitosan.

The preparation of the aliquot used for measuring the Canadian Standard Freeness and the chitosan solution are as described in Example 1. The chitosan solution is added slowly with stirring to the pulp suspension. The amount of spent green liquor is then varied and the drainage measurement taken.

Results are as follows:

| Spent Green Liquor, g/l | Drainage, ml[1] |
|---|---|
| Blank[2] | 205 |
| 0[3] | 305 |
| 1 | 240 |
| 2 | 255 |
| 3 | 275 |
| 4 | 230[4] |
| 5 | 290 |
| 6 | 275 |
| 7 | 290 |
| 8 | 285 |

[1]Canadian Standard Freeness, modified to 5 gms. of dry pulp; contact time = 5 min., unless otherwise noted.
[2]0 chitosan and 0 spent green liquor
[3].3% chitosan and 0 spent green liquor.
[4]Contact Time = 10–15 min.

EXAMPLE 3

The following illustrates the independence of the increase of flat crush resistance in the presence of chitosan to spent brown liquor from the neutral sulfite semichemical pulp process of corrugating medium pulp.

The pulp suspension is prepared as described in Example 1 except 75% pulp from the neutral sulfite semichemical pulping process is used instead of the green liquor semichemical pulp and a spent brown liquor solution containing 9.0% solids is used instead of a spent green liquor solution containing a 4.5% solids.

The results are essentially as described graphically in FIG. 1.

EXAMPLE 4

The following example illustrates the effect of pH on flat crush resistance of corrugating medium pulp in the presence of chitosan. This example is described graphically in FIG. 2.

Same procedure as Example 1 is used except the final pH of the 0.5% consistency pulp suspension with chitosan was varied within the range 3.5 to 8.5. Then sheets were made by the same procedure. The level of spent green liquor in this example was kept constant at 3g/l.

EXAMPLE 5

The following example illustrates the effect of flat crush resistance by varying the amount of chitosan on the corrugating medium fiber.

Same procedure as Example 1 is used except the level of chitosan was varied over the range 0.1% to 0.6% on fiber. The level of spent green liquor in this example was kept constant at 3g/l.

The results are as follows:

| Run No. | Chitosan[1] Added | Concora[2] |
|---|---|---|
| Blank | 0 | 54.5 |
| 1 | 0.1 | 62.7 |
| 2 | 0.2 | 66.3 |
| 3 | 0.3 | 60.4 |
| 4 | 0.4 | 79.8 |
| 5 | 0.5 | 74.3 |

-continued

| Run No. | Chitosan[1] Added | Concora[2] |
|---|---|---|
| 6 | 0.6 | 75.7 |

[1]%, based on the dry weight of the fiber
[2]lb., TAPPI standard T 809-OS-71

EXAMPLE 6

The following illustrates the increase in flat crush resistance from chitosan dissolved in various solvents.

Solutions are prepared by dissolving chitosan in aqueous acetic acid as in Example 1 except 1M acetic acid is used, and by dissolving chitosan to the extent possible in 94 wt% glycerine containing 6 wt% acetic acid and in 94 wt% ethylene glycol containing 6 wt% acetic acid.

Example 1 is repeated except that the spent green liquor is added at 4 grams per liter of pulp suspension, the pH of the pulp suspension is adjusted to 8, and the chitosan solution added is 0.25% chitosan based on the dry weight of the fiber.

The results are as follows:

| Chitosan solution | Concora[1] |
|---|---|
| Blank | 56.9 lbs. |
| In acetic acid[2]-water | 65.9 lbs |
| Blank | 57.6 lbs. |
| In acetic acid-glycerine[3] | 66.2 lbs. |
| Blank | 60.3 lbs. |
| In acetic acid-ethylene glycol[4] | 67.5 lbs. |

[1]lb., Tappi Standard T 809-OS-71
[2]1M
[3]94 wt% glycerine; 6 wt% acetic acid
[4]94 wt% ethylene glycol; 6 wt% acetic acid

I claim:

1. A process for improving the flat crush resistance of a corrugating medium semi-chemical pulp which comprises:
   (a) adding to said corrugating medium, at a pH of from about 5–9, a chitosan solution in an amount to provide therein from at least about 0.05% to about 0.6%, based on dry fiber weight, of chitosan, said medium containing from at least about 0.05% to about 32%, based on dry fiber weight, of spent semi-chemical pulping liquor;
   (b) forming a web of said corrugating medium pulp;
   (c) drying said web; and
   (d) corrugating said web.

2. A process described in claim 1 wherein said chitosan solution is prepared by dissolving dry flakes of chitosan in dilute acid at a pH of about 2.0–5.5.

3. A process described in claim 2 wherein the dry flakes of chitosan are dissolved in dilute acid selected from the group comprising acetic acid or hydrochloric acid.

4. A process described in claim 2 wherein the dry flakes of chitosan are dissolved in a solvent selected from the group comprising glycerine-acetic acid or ethylene glycol-acetic acid.

5. A process described in claim 2 wherein the dry flakes of chitosan are pulverized prior to dissolving.

6. A process described in claim 1 wherein said chitosan solution has a viscosity of about 10 to 3000 cps.

7. A process described in claim 1 wherein the pH of step (a) is from about 7–8.

8. Corrugating medium manufactured by the process of claim 1.

9. Corrugating medium manufactured by the process of claim 3.

* * * * *